US010895162B2

(12) United States Patent
Schlemmer et al.

(10) Patent No.: US 10,895,162 B2
(45) Date of Patent: Jan. 19, 2021

(54) GUIDE VANE SEGMENT FOR A TURBOMACHINE

(71) Applicant: MTU Aero Engines AG, Munich (DE)

(72) Inventors: Markus Schlemmer, Mainburg/Sandelzhausen (DE); Manfred Feldmann, Eichenau (DE); Rudolf Stanka, Rattenkirchen (DE); Oliver Thiele, Dachau (DE)

(73) Assignee: MTU Aero Engines AG, Munich (DE)

( * ) Notice: Subject to any disclaimer, the term of this patent is extended or adjusted under 35 U.S.C. 154(b) by 454 days.

(21) Appl. No.: 15/428,386

(22) Filed: Feb. 9, 2017

(65) Prior Publication Data

US 2017/0241279 A1 Aug. 24, 2017

(30) Foreign Application Priority Data

Feb. 18, 2016 (DE) ..... 10 2016 202 519

(51) Int. Cl.

| | |
|---|---|
| ***F01D 11/00*** | (2006.01) |
| ***F01D 9/04*** | (2006.01) |
| ***F01D 25/24*** | (2006.01) |

(52) U.S. Cl.

CPC ..... *F01D 9/041* (2013.01); *F01D 9/04* (2013.01); *F01D 9/042* (2013.01); *F01D 11/001* (2013.01);

(Continued)

(58) Field of Classification Search

CPC . F01D 9/041; F01D 9/042; F01D 9/04; F01D 11/003; F01D 11/005;

(Continued)

(56) References Cited

U.S. PATENT DOCUMENTS 3,829,233 A * 8/1974 Scalzo ..... F01D 11/005 277/419

4,194,869 A 3/1980 Corcokios (Continued)

FOREIGN PATENT DOCUMENTS

DE 69825961 T2 9/2005

DE 102005045459 A1 4/2006

(Continued)

*Primary Examiner* — Justin D Seabe

*Assistant Examiner* — Andrew J Marien

(74) *Attorney, Agent, or Firm* — Barlow, Josephs & Holmes, Ltd.

(57) ABSTRACT

The invention relates to a guide vane segment for an aircraft engine, having at least one guide vane element, having at least one flange formed in a radial extension direction (R) of the guide vane element and at least one positioning member projecting from the flange in the radial extension direction (R), and at least one seal carrier, which is arranged at the flange and is aligned relative to the guide vane element by way of the positioning member, wherein the flange has a supporting surface on which the seal carrier is supported, wherein a partial surface of the positioning member is adjacent to the flange at a transition from the flange to the positioning member, and respective surface normal lines of the supporting surface and of the partial surface enclose between them an angle (α) that is different from a zero angle.

9 Claims, 2 Drawing Sheets

Figure 1:
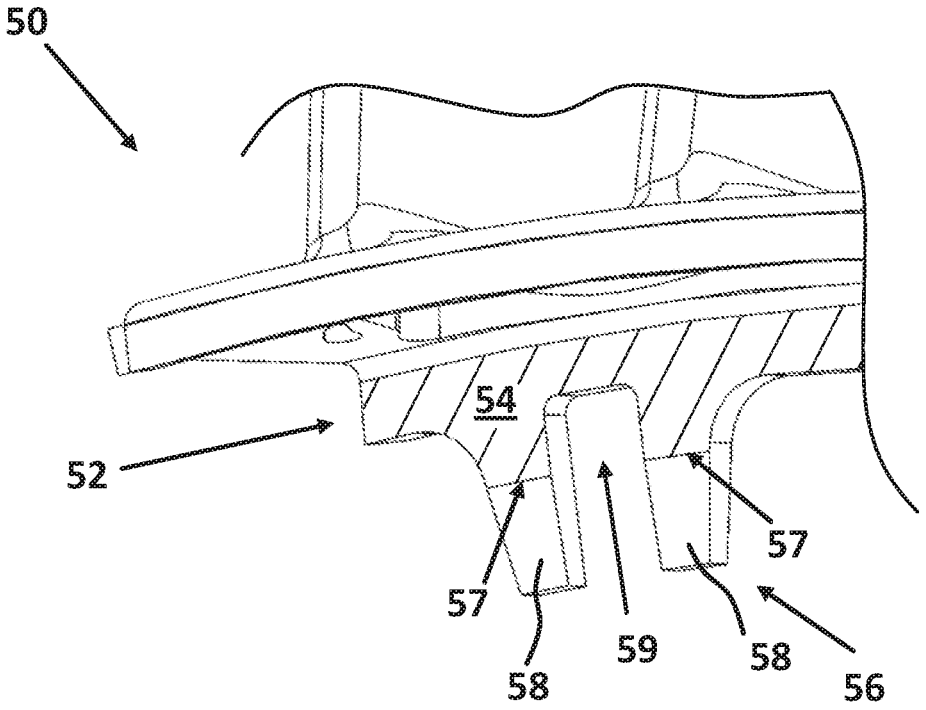
Fig. 1 (Prior Art)

(52) U.S. Cl.
CPC ..... *F01D 11/003* (2013.01); *F01D 11/005* (2013.01); *F01D 25/243* (2013.01); *F05D 2220/323* (2013.01); *F05D 2240/12* (2013.01); *F05D 2240/55* (2013.01)

(58) Field of Classification Search
CPC .... F01D 11/001; F01D 25/243; F01D 25/246; F05D 2240/55; F05D 2240/12; F05D 2220/323
See application file for complete search history.

(56) References Cited

U.S. PATENT DOCUMENTS 4,286,921 A * 9/1981 Donlan ..... F01D 11/001 415/136
4,863,343 A * 9/1989 Smed ..... F01D 9/042 415/138
4,890,978 A * 1/1990 McLaurin ..... F01D 9/04 415/137
5,215,435 A * 6/1993 Webb ..... F01D 5/08 277/414
5,224,822 A * 7/1993 Lenahan ..... C23C 30/00 415/189
6,637,751 B2 * 10/2003 Aksit ..... F01D 9/041 277/416
8,757,966 B2 * 6/2014 Blanchard ..... F01D 9/042 415/190
9,752,506 B2 * 9/2017 Schwartz ..... F02C 7/20
9,856,736 B2 * 1/2018 Stiehler ..... F01D 11/02
9,869,200 B2 * 1/2018 Jones ..... F01D 5/189
9,903,216 B2 * 2/2018 Chuong ..... F01D 11/001
10,060,279 B2 * 8/2018 Vo ..... F01D 11/001
10,094,389 B2 * 10/2018 Chuong ..... F02C 7/28
2006/0062673 A1 * 3/2006 Coign ..... F01D 9/041 416/214 A
2013/0045089 A1 * 2/2013 Bridges ..... F01D 5/082 415/173.7
2014/0044537 A1 * 2/2014 Hackenberg ..... F01D 11/001 415/209.3
2014/0227080 A1 8/2014 Stiehler et al.
2017/0159466 A1 * 6/2017 Schlemmer ..... F01D 9/041

FOREIGN PATENT DOCUMENTS

DE 102005059084 A1 6/2007
DE 102008037501 A1 5/2009
EP 2551454 A2 1/2013
EP 2559849 A2 2/2013
EP 2696039 A1 2/2014
EP 2722486 A1 4/2014
EP 2811117 A2 12/2014
EP 2811117 A3 2/2015
EP 2559849 A2 5/2017
FR 2979662 A1 3/2013

* cited by examiner

GUIDE VANE SEGMENT FOR A TURBOMACHINE

BACKGROUND OF THE INVENTION

The invention relates to a guide vane segment for a turbomachine, in particular for an aircraft engine. Other aspects of the invention relate to a guide vane element for such a guide vane segment, a guide vane ring having at least one guide vane segment, and a turbomachine.

In the manufacture of turbomachines, it is known to assemble guide vane rings from a plurality of guide vane segments. Such guide vane rings serve for directing a medium (working medium) flowing through turbomachines during the operation thereof. In this alignment, at least one part of the kinetic energy of the flowing medium can be converted into a swirling energy by guide vane rings. This swirling energy can be utilized in order to move (to drive) a rotor connected to the guide vane ring and to set in rotational motion thereby a drive shaft of the turbomachine connected to the rotor. In order to operate turbomachines with as great an efficiency as possible, it is meaningful to keep any gaps as small as possible—for example, gaps between the guide vane ring and a shaft housing part adjacent thereto in a radial extension direction. In this way, an undesired fluid leakage of the medium can at least be largely prevented.

A gas turbine that has a sealing ring element mounted via a spoke centering on a guide vane root is known from EP 2 696 039 A1. This spoke centering has an inner wall and a peripheral groove that takes it up. The inner wall has an end face that faces an internal surface area of the groove as well as a flanking side that is adjacent to this end face and is angled thereto. A rounding between the end face and the flanking side is formed as radius. When the gas turbine stage is installed as intended in a system, this radius reduces the tension loading and the wear of the front end face in the through-flow direction at the internal surface area of the groove.

EP 2 722 486 A1 shows a fish-mouth seal holder or seal carrier for a guide vane arrangement of a gas turbine. The fish-mouth seal carrier has a box profile with two axial limbs and two radial limbs, as well as a seal element that is arranged on one of the axial limbs. An integrally formed axial flange is provided on the box profile for the formation of a fish-mouth seal.

A low-pressure turbine that has a plurality of stator stages is known from EP 2 551 454 A2. Honeycomb structures are arranged at the respective radial ends of the stator stages with labyrinth seals lying radially opposite to these at a shaft housing in order to form a sealing site with little fluid leakage.

In addition, U.S. Pat. No. 4,194,869 shows a guide vane cluster with fastening member for retaining the position of the guide vane cluster in a gas turbine. Any flowing around the guide vane cluster at undesired places can be reduced by this positional retaining.

SUMMARY OF THE INVENTION

The object of the present invention is to improve a guide vane segment, a guide vane element, a guide vane ring, as well as a turbomachine of the type named initially, so that these components also are very tight against a fluid leakage when intense stressing occurs.

This object is achieved by a guide vane segment, by a guide vane element, by a guide vane ring as well as by a turbomachine according to the present invention. Advantageous embodiments with appropriate enhancements of the invention are discussed in detail below, wherein advantageous embodiments of each aspect of the invention are to be viewed as advantageous embodiments of each of the other aspects of the invention, and vice versa.

A first aspect of the invention relates to a guide vane segment for a turbomachine, in particular for an aircraft engine, having: at least one guide vane element that comprises at least one flange formed in a radial extension direction of the guide vane element and at least one positioning member projecting out from the flange in the radial extension direction, and at least one seal carrier that is arranged at the flange and is aligned relative to the guide vane element by way of the positioning member, wherein the flange has a supporting surface on which the seal carrier is supported.

According to the invention, a partial surface of the positioning member is adjacent to the flange at a transition from the flange to the positioning member, and respective surface normal lines of the supporting surface and the partial surface enclose an angle different from a zero angle. This has the advantage that the tightness between the seal carrier and the flange is improved, since the surface (supporting surface) at which the seal carrier is supported is smaller in comparison to systems known from the prior art, and therefore, a greater pressing together of the surfaces results between the seal carrier and the sealing surface. In addition, a relative tipping of the seal carrier at the positioning member and thus an accompanying lifting off of the seal carrier from the supporting surface under large loads can also be prevented. The seal carrier can be designed, for example, as a one-part, ring-shaped seal carrier.

The transition from the flange to the positioning member can be formed, for example, as a straight line or as a bent line, at which the flange and the partial surface can bound one another. The transition can also be formed as an edge, for example with an edge rounding, at which the flange and the partial surface are adjacent to one another. It goes hand in hand with the inclusion of an angle that is different from zero, by way of the respective surface normal lines of the supporting surface and of the partial surface, that the partial surface can be displaced opposite the supporting surface, at least in regions. Correspondingly, when the guide vane segment is used as intended as a component of a turbomachine, the partial surface is set back opposite the supporting surface, in a primary flow direction of a working medium flowing through the turbomachine during operation of the latter. In this case, for example, the partial surface can run with a slope or bevel opposite the supporting surface, at least in regions. Additionally or alternatively, the partial surface and the supporting surface can also form a part of a shoulder at the flange. The supporting surface can thereby be configured as a sealing surface radially surrounding the flange, opposite which the partial surface is set back and additionally or alternatively can be beveled. This is of advantage, since the seal carrier, which can also be called an SIAS (static inner air seal) can be applied only onto the supporting surface, and not additionally onto the positioning member, as is known from the prior art, so that a better sealing effect can be achieved between the supporting surface and the seal carrier. When there is a load on the seal carrier as a consequence of the operation of the turbomachine, it can therefore be effectively prevented that the seal carrier tips around a support site at the positioning member and thus lifts off from the supporting surface, whereby fluid leakage may occur. By way of the partial surface of the positioning member that is beveled and additionally or alternatively set back opposite the supporting surface, it is assured that the SIAS cannot lift off from the supporting surface even when a relative movement, which is caused by loading, occurs between the SIAS and the guide vane element; specifically, the SIAS cannot be supported in a disadvantageous manner at the positioning member. Therefore, in contrast to solutions known from the prior art, a tipping of the SIAS around the positioning member will be excluded and—again in contrast to solutions known from the prior art—a very tight seal can be achieved against fluid leakage even in the case of intense loads.

The guide vane segment can correspond to a part of a guide vane ring, and, for example, can be designed as a guide vane ring segment. Correspondingly, the guide vane segment can be configured, for example, as one-third of such a guide vane ring and thus as a 120° segment. In addition to the flange and the positioning member, the guide vane segment can comprise, for example, a radially inner shroud segment, a guide vane element, or a plurality of guide vane elements, as well as a radially outer shroud segment. At a radial end, the seal carrier can have a sealing element, for example, in the form of a brush seal or a honeycomb seal. By way of such a sealing element, when the guide vane segment is used as intended in the turbomachine, an undesired fluid leakage between the sealing element and, for example, a housing region of a drive shaft of the turbomachine can at least be reduced. The supporting surface can be formed as the sealing surface in order to reduce any fluid leakage between the flange and the seal carrier. In the case of the arrangement of the seal carrier at the flange, the positioning member can engage in a surrounding radial groove of the seal carrier, for example. In addition, the seal carrier can be fixed to the flange and thus to the guide vane element by way of a fixing element, which can be formed, for example, as a bolt.

In an advantageous embodiment of the invention, the supporting surface is designed as an annular surface segment, at least essentially. A particularly uniform pressing together of surfaces between the seal carrier and the supporting surface can be achieved thereby. This has the advantage that a uniform sealing effect also can be achieved at the supporting surface even under dynamic loads of the seal carrier.

In another advantageous embodiment of the invention, the positioning member is joined as one part with the flange. Because of this, few individual parts are needed for the construction of the guide vane element. This is of advantage, since the guide vane segment can thus be manufactured with particularly low expenditure for assembly.

In another advantageous embodiment of the invention, the seal carrier has at least one encircling radial groove with which the positioning member is engaged in the arrangement of the seal carrier at the flange. This is of advantage, since an encompassing engagement of the flange and the positioning member by the groove is made possible with the arrangement of the seal carrier. Any degrees of freedom of movement between the seal carrier and the guide vane element will be limited thereby in a simple way.

In another advantageous embodiment of the invention, the positioning member has at least two positioning mandrels, which are arranged fork-like to one another and which engage in the encircling radial groove in the arrangement of the seal carrier at the flange. The fork-like arrangement of the positioning mandrels can also be called spoke centering. Any rotation or twisting of the seal carrier around the two positioning mandrels can be prevented by the fork-like embodiment. Therefore, another degree of freedom of movement of the seal carrier can be limited in a simple way.

A second aspect of the invention relates to a guide vane element for a guide vane segment according to the invention, with a flange formed in a radial extension direction of the guide vane element, the flange having a supporting surface for the arranging and supporting of a seal carrier, and with at least one positioning member projecting from the flange in the radial extension direction for aligning the seal carrier relative to the guide vane element.

According to the invention, at a transition from the flange to the positioning member, a partial surface of the positioning member is adjacent to the flange, and respective surface normal lines of the supporting surface and of the partial surface enclose between them an angle different from a zero angle. A particularly high sealing effect between the supporting surface and a seal carrier supported at the latter is achieved by such a guide vane element.

A third aspect of the invention relates to a guide vane ring comprising at least one guide vane segment according to the invention. The guide vane ring, for example, can be assembled from three 120° guide vane segments. Such a guide vane ring contributes to improved ways for reducing fluid leakage.

A fourth aspect of the invention relates to a turbomachine, in particular an aircraft engine, having at least one guide vane segment according to the invention, and additionally or alternatively, having at least one guide vane element according to the invention, and additionally or alternatively, having at least one guide vane ring. Such a turbomachine can be operated with reduced fluid leakage and thus can be operated with a particularly high efficiency.

In an advantageous embodiment of the invention, the turbomachine is a turbine, and the supporting surface of the flange is facing a primary flow direction of a working medium flowing through the turbomachine during the operation thereof. This is of advantage, since any lifting off of the seal carrier from the supporting surface can be at least largely prevented as a consequence of a flow by the working medium when there are any loads onto the seal carrier arranged at the flange. The seal carrier thus is also applied flatly onto the supporting surface during the loading thereof, whereby a fluid leakage between the seal carrier and the supporting surface can be reduced or even prevented.

In another advantageous embodiment of the invention, the turbomachine is a compressor, and the supporting surface of the flange is facing away from a primary flow direction of a working medium flowing through the turbomachine during the operation thereof. Any lifting off of the seal carrier from the supporting surface in a compressor also can be at least largely prevented thereby.

BRIEF DESCRIPTION OF THE DRAWING FIGURES

Figure 2A:
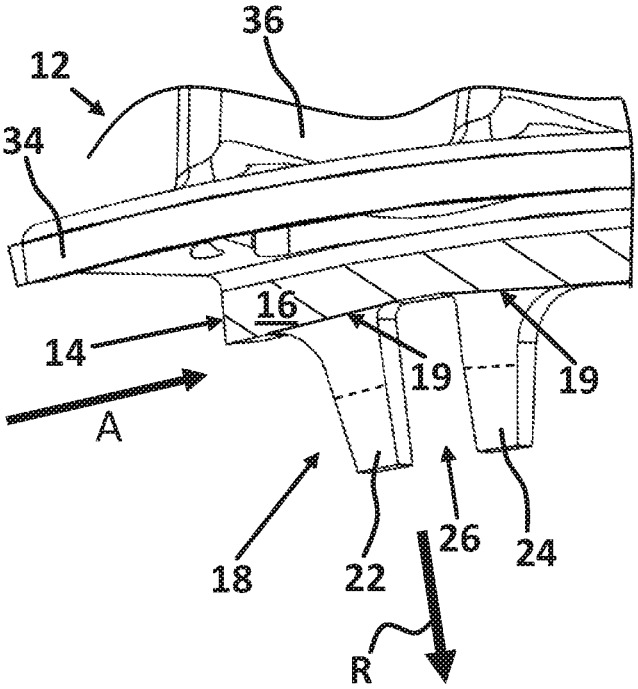
Figure 2B:
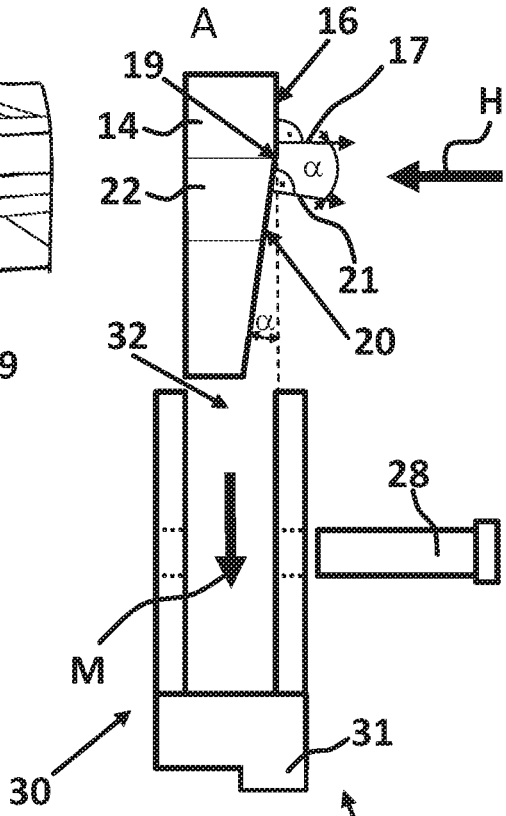
Figure 3:
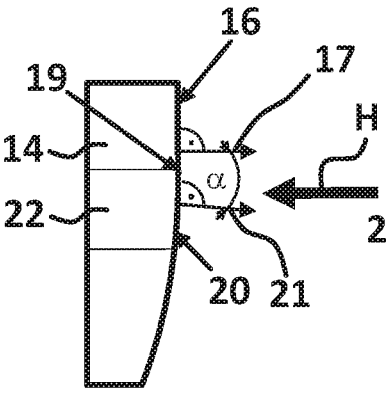
Figure 4A:
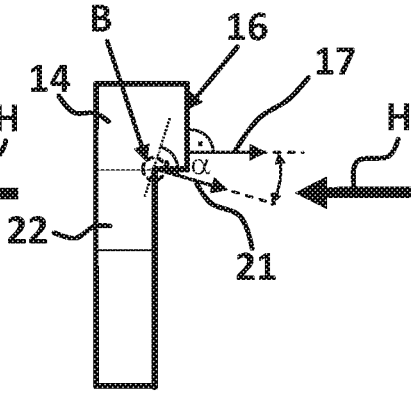
Figure 4B:
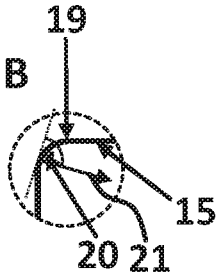

Additional features of the invention result from the claims, the exemplary embodiments, as well as on the basis of the drawings. The features and combinations of features named above in the description as well as the features and combinations of features named below in the examples of embodiment can be used not only in the indicated combination in each case, but also in other combinations, without departing from the scope of the invention. Here:

FIG. 1 shows a perspective view of a guide vane segment known from the prior art;

FIG. 2*a* shows a perspective view of an exemplary embodiment of a guide vane element of the invention shown by way of an excerpt;

FIG. 2*b* shows a lateral view onto a partial region of the guide vane element shown in FIG. 2*a*, onto which a seal carrier is moved;

FIG. 3 shows a lateral view onto a partial region of another embodiment of the guide vane element in which a partial surface of a positioning member of the guide vane element has a curvature and is directly adjacent to the supporting surface of the flange;

FIG. 4*a* shows a lateral view onto a partial region of another embodiment of the guide vane element in which the flange and the positioning member form a shoulder; and FIG. 4*b* shows a detail view of a region outlined by the dashed line in FIG. 4*a*.

DESCRIPTION OF THE INVENTION

FIG. 1 shows a guide vane segment 50, which is known from the prior art, for a turbomachine. The guide vane segment 50 has a planar sealing surface 54 at a sealing region 52; a radial seal, which is not shown here, can be brought into contact with the sealing surface. In addition, the guide vane segment 50 has a toothed centering 56 for the radial seal. The sealing surface 54 presently extends over a particularly large region, which is cross-hatched in FIG. 1, and which also comprises a partial surface region of individual centering elements of the toothed centering 56. The sealing surface 54 in this case extends up to a contact line 57 of the centering 56. In this case, the contact line 57 extends over two centering bars 58 of the centering 56, these bars being arranged in a fork-like manner to one another. The contact line 57 can also be referred to as a support site at an edge region of the sealing surface 54. Based on the extent of the sealing surface 54 on the centering bars 58 and thus on regions of the centering 56, increased fluid leakage can occur between the sealing surface 54 and the radial seal, if the sealing surface 54 and the radial seal are at an unfavorable angle to each other, which is caused by loads during operation. This is due to the fact that there occurs a tipping of the radial seal around the contact line 57 onto the centering as a consequence of operationally-caused deformations. A consequence thereof is a lifting off of the radial seal from the sealing surface 54 and a fluid leakage, in particular in a recessed region 59 between the centering bars 58; in particular, the sealing surface 54 extends around this recessed region 59 in zones.

A guide vane element 12 is illustrated in FIG. 2*a*, this element being shown together with a seal carrier 30 in a lateral view in FIG. 2*b* according to a viewing direction A illustrated by an arrow in FIG. 2*a*.

The guide vane element 12 and the seal carrier 30 belong to a guide vane segment 10 shown in an excerpt in FIG. 2*b*, for a turbomachine, which is not shown here, and which can be designed, for example, as an aircraft engine. The guide vane segment 10 thus comprises the guide vane element 12 and the seal carrier 30. A guide vane ring, which is not shown here, can be assembled from a plurality of such guide vane segments 10 and can be used in the turbomachine.

The guide vane element 12 presently comprises at least one vane body 36, a radially inner shroud segment 34, and a radially outer shroud segment, which is not shown here. The two shroud segments are connected to the body at opposite-lying sides of the at least one vane body 36. In addition, the guide vane element 12 comprises a flange 14 formed in a radial extension direction R of the guide vane element 12 and at least one positioning member 18 projecting from the flange 14 in the radial extension direction R. The positioning member 18 presently is joined as one part with flange 14.

In FIG. 2*b*, the guide vane segment will be moved in a direction of assembly M into the presently ring-shaped seal carrier 30, so that the seal carrier 30 and the flange 14 lie against one another. The seal carrier 30 and the guide vane element 12 are aligned relative to one another by way of the positioning member 18. The flange 14 has a supporting surface 16 at which is supported the seal carrier 30 at the contact line thereof with the flange 14. The supporting surface 16 of the flange 14 is facing a primary flow direction H of a working medium flowing through the turbomachine during the operation thereof, as long as the turbomachine is configured as a turbine. When the turbomachine is configured as a compressor, in contrast, the supporting surface 16 of the flange 14 would face away from the primary flow direction H.

The supporting surface 16 serves as the sealing surface, with which the seal carrier 30 forms a sealing seat in the arrangement and support thereof at the flange 14. The supporting surface 16 presently is at least substantially formed as an annular surface segment. The phrase "at least substantially formed as an annular surface segment" is to be understood such that the supporting surface 16 is predominantly configured as an annular surface segment; however, it can deviate from an annular configuration in regions by delimiting the supporting surface by, for example, a straight segment instead of by a circular arc in regions. Therefore, in particular, it is comprised such that the supporting surface 16 can be delimited in the radial extension direction R also by a transition 19, which is formed as a straight line, for example, and correspondingly, does not have a surrounding radial rounding at such a delimitation site, and deviates slightly from an annular segment configuration.

A partial surface 20 of the positioning member 18 delimits the flange 14 at the transition 19 from the flange 14 to the positioning member 18, wherein respective surface normal lines 17, 21 of the supporting surface 16 and of the partial surface 20 enclose between them an angle $\alpha$ that is different from a zero angle. The first surface normal line 17 in this case is assigned to the supporting surface 16, whereas the second surface normal line 21 is assigned to the partial surface 20.

The seal carrier 30 presently has a surrounding radial groove 32, by which the positioning member 18 is engaged in the arrangement of the seal carrier 30 at the flange 14. A sealing element 31, which is formed, for example, as a brush seal or a honeycomb seal, is arranged at one end of the seal carrier 30.

The seal carrier 30 can be fixed at the flange 14 as soon as the seal carrier 30 is brought into contact with the supporting surface 16, by a fixing element, which is shown in FIG. 2*b*, and is presently formed as a bolt 28. The positioning member 18 has here two positioning mandrels 22, 24, disposed fork-like relative to one another, these mandrels engaging in the surrounding radial groove 32 in the arrangement of the seal carrier 30 at the flange 14. The bolt 28 can be guided through a recess 26 bounded in regions by the two positioning mandrels 22, 24, for fixing the seal carrier 30. The positioning mandrels 22, 24 can each also be called a "tang".

Different embodiments of the guide vane element 12 are shown in each of FIG. 2*b*, FIG. 3 and FIG. 4*a*. In these figures, only the first positioning mandrel 22 is shown as representative of the two positioning mandrels 22, 24; positioning mandrel 22 covers up the second positioning mandrel 24 in these figures.

The partial surface 20 of the positioning mandrel 22 and thus of the positioning member 18 is directly adjacent to the transition 19. The surface normal lines 17, 21 enclose the angle α, as already mentioned, and this angle can also be called a "tang angle".

While the partial surface in the exemplary embodiment shown in FIG. 2*b* is formed as a straight surface, beveled relative to the supporting surface 16, the exemplary embodiment according to FIG. 3 shows a curved course of the partial surface 20 and thus a curvature of the partial surface 20. Just like in the embodiments explained in FIG. 2*b* and FIG. 3, it is also assured in the embodiment shown in FIG. 4*a* that the seal carrier 30 can be applied flat onto the supporting surface 16, in this case without coming into contact with the partial surface 20 and thus the positioning member 18. An arrangement of the seal carrier 30 at the supporting surface 16 with a strong pressing together of surfaces and thus a particularly good sealing effect can be ensured thereby. It is shown in FIG. 4*a* that the guide vane element 12 can have a shoulder that is shown enlarged in FIG. 4*b* according to a detail view B. In this case, the shoulder extends over a flange surface 15 of flange 14 that is adjacent to the supporting surface 16.

In summary, with supporting surface 16, a supporting surface segment will be created that is free of discontinuities and that is encircling in regions along the guide vane element 12, and a sealing seat with the seal carrier 30 (SIAS) can be formed at this segment.

A radial position of a vertex of the angle α can lie at the transition 19—as shown in FIG. 2*b*, wherein the partial surface 20 is connected to the supporting surface 16 and beveled relative thereto. The angle α, however, can also change over the course of the partial surface 20, as is shown in FIG. 3. Due to the fact that the surface normal lines 17, 21 of the supporting surface 16 and of the partial surface 20 enclose the angle α that is different from the zero angle, an offset results between the supporting surface 16 and the partial surface 20 in the primary flow direction H. This offset makes it possible that deformations of the SIAS (seal carrier 30) caused during operation can be permitted without the occurrence of a lifting of the seal carrier 30 from the supporting surface 16 during these deformations.

Also, additional local projections, which can bound the supporting surface 16 encircling the guide vane element 12, can be provided with the angle α, so that the SIAS obtains space for deformations caused by operation and the local projections are not contacted by the SIAS in the case of deformation. The term "projections" include those elements that project radially inward (in the radial extension direction R) relative to the supporting surface 16 (sealing surface at the flange 14). The term "projections" includes, for example, elements for securing against rotation or twisting, or sprues.

Even when strong deformations occur between the SIAS and the guide vane segment 10, or the guide vane ring, the present invention can prevent the SIAS from tipping in the primary flow direction H around a contact line 57; such tipping is known from the prior art (at the centering 56, which is shown in FIG. 1), and in this case, a flat, cone-shaped gap will be formed between the SIAS and the supporting surface 16. When this gap is formed, it can lead to an increased fluid leakage in the case of systems known from the prior art.

What is claimed is:

1. A guide vane segment for a turbomachine, comprising:

at least one guide vane element, which includes at least one flange formed in a radial extension direction of the guide vane element and at least one positioning member projecting from the flange in the radial extension direction, and at least one seal carrier, which is positioned at the flange and is aligned relative to the guide vane element by way of the positioning member, wherein the flange has a supporting surface on which the seal carrier is supported;

wherein a partial surface of the positioning member is adjacent to the flange at a transition from the flange to the positioning member, and respective surface normal lines of the supporting surface and of the partial surface enclose between them an angle that is different from a zero angle, wherein the at least one seal carrier has at least one encircling radial groove, with which the positioning member is engaged in the arrangement of the seal carrier at the flange, wherein the positioning member has at least two positioning mandrels arranged fork-like to one another extending directly downward from the supporting surface, the partial surface of the position member defines at least a portion of a face of the respective mandrels, and these mandrels engaging in the encircling radial groove in the arrangement of the seal carrier at the flange, wherein a gap is defined between the seal carrier and the face of the respective mandrels along an entire length of the mandrel, and wherein the partial surface is at least a partially curved surface.

2. The guide vane segment according to claim 1, wherein the supporting surface is at least substantially formed as an annular surface segment.

3. The guide vane segment according to claim 1, wherein the positioning member is joined as one part with the flange.

4. A guide vane element for the guide vane segment according to claim 1, wherein, with the at least one flange formed in the radial extension direction of the guide vane element, the at least one positioning member projecting from the flange in the radial extension direction for the alignment of the seal carrier relative to the guide vane element, and wherein the partial surface of the positioning member is adjacent to the flange at a transition from the flange to the positioning member, and respective surface normal lines of the supporting surface and of the partial surface enclose between them an angle that is different from a zero angle.

5. A guide vane element according to claim 1, wherein at least one guide vane segment is arranged into a guide vane ring.

6. A guide vane element according to claim 5, wherein at least one guide vane segment and/or at least one guide vane element is arranged into an aircraft engine.

7. A guide vane element according to claim 6, wherein the turbomachine is a turbine and the supporting surface of the flange is facing a main flow direction of a working medium flowing through the turbomachine during the operation thereof.

8. A guide vane element according to claim 6, wherein the turbomachine is a compressor, and the supporting surface of the flange is facing away from a main flow direction of a working medium flowing through the turbomachine during the operation thereof.

9. The guide vane segment according to claim 1, wherein the partially curved surface extends directly from a planar surface which extends directly from the supporting surface.

* * * * *